US006601850B1

(12) United States Patent
Ross

(10) Patent No.: US 6,601,850 B1
(45) Date of Patent: Aug. 5, 2003

(54) PROGRESSING PATTERN MEMORY GAME AND ITS ASSOCIATED METHOD OF PLAY

(76) Inventor: Brad Ross, 484 W. 43rd St. #31-T, New York, NY (US) 10036

( * ) Notice: Subject to any disclaimer, the term of this patent is extended or adjusted under 35 U.S.C. 154(b) by 0 days.

(21) Appl. No.: 09/978,289

(22) Filed: Oct. 17, 2001

(51) Int. Cl.[7] ..... A63F 9/08
(52) U.S. Cl. ..... 273/273
(58) Field of Search ..... 273/153 R, 429, 273/273

(56) References Cited

U.S. PATENT DOCUMENTS 4,240,638 A 12/1980 Morrison et al. ..... 273/237
5,411,271 A * 5/1995 Mirando
5,803,458 A 9/1998 Snyder ..... 273/273
6,287,197 B1 * 9/2001 Dickinson et al.

* cited by examiner

*Primary Examiner*—William M. Pierce
(74) *Attorney, Agent, or Firm*—LaMorte & Associates

(57) ABSTRACT

A game and its associated method of play. The game contains a plurality of object areas in which game objects may be placed. Game objects are randomly added to, or removed from, the object areas one by one. Before the addition or removal of each new object, the player is made to visualize a neutral field of play that is either completely filled with game objects or devoid of game objects. As such, each time a player views the object areas, an additional game object has been added or removed, but the player does not know which object has just been added. Using memories of the object areas when last viewed, a player tries to identify which of the game objects present is the game object that was just added or removed. If the player selects correctly, the cycle is repeated and another game object is randomly added or removed. If the player selects the wrong game object, the game ends.

17 Claims, 5 Drawing Sheets

PROGRESSING PATTERN MEMORY GAME AND ITS ASSOCIATED METHOD OF PLAY

BACKGROUND OF THE INVENTION

1. Field of the Invention

The present invention relates to pattern games, wherein during the course of play, a player is required to memorize a specific pattern. More particularly, the present invention game and method of play relate to games where a player is provided with a momentary glimpse of a pattern, and is then required to remember that pattern in order to advance in the game during the course of play.

2. Prior Art Statement

The prior art is replete with different types of memory games that require players to memorize patterns. Through the years, such pattern games have been created in many forms. For instance, there are many different types of card games that require players to remember the position and the image of a specific card among a plurality of cards. Many board games have also been created, where players must remember patterns hidden under game pieces. Such board games are exemplified by U.S. Pat. No. 5,803,458 to Snyder, entitled Memory Maze Game.

However, with modern games, patterns are typically presented to players in an electronic format. For example, in U.S. Pat. No. 4,240,638 to Morrison, entitled Microprocessor Controlled Game Apparatus, an electronic display board is provided that contains a hidden maze pattern. Players must try to discover the hidden maze pattern using trial and error and by remembering the parts of the maze pattern previously discovered.

In U.S. Pat. No. 4,363,482 to Goldfarb, an electronic pattern memory game is disclosed. In this game, lights associated with different buttons are lit in some predetermined sequence. After the game electronically lights the sequence of lights, a player must push the various buttons in the same sequence as the lights that were lit. If the player is successful, the sequence of the pattern is increased in length to make the game increasingly difficult.

From the above, it will be understood that many games exist that require a player to memorize a particular pattern and remember that pattern in order to advance in the play of the game. Such memory games come in many formats including cards games, board games and electronic games. The present invention game and method of play provides a new type of pattern recognition game that can be applied to the known formats of card games, board games and electronic games. The present invention game and method of play require a player to use his/her pattern recognition skills and short term memory in a new and entertaining way, as will be described and claimed below.

SUMMARY OF THE INVENTION

The present invention is a game and its associated method of play. The game contains a plurality of object areas in which game objects may be placed. Game objects are randomly added to, or removed from, the object areas one by one. Before the addition of each new object, the player is made to visualize a neutral field of play that is either completely filled with game objects or devoid of game objects. As such, each time a player views the object areas, an additional game object has been either added or removed, but the player does not know which part of the pattern has just been changed. Using memories of the object areas when last viewed, a player tries to identify which of the game objects present is the game object that was just added or removed. If the player selects correctly, the cycle is repeated and another game object is randomly added. If the player selects the wrong game object, the game ends.

The present invention game and method of play can be configured as software, an electronic game, a board game or a card game. In all formats, the method of play remains consistent.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention game can be adapted to many different formats, the method of play associated with the game remains the same. As such, by way of example, the present invention game will be described in four separate formats, wherein each of the formats retains the same basic method of play. The formats illustrated are merely exemplary and it should be understood that the game can be adapted to other undescribed formats that are intended to be included within the scope of the description and the claims.

Figure 1:
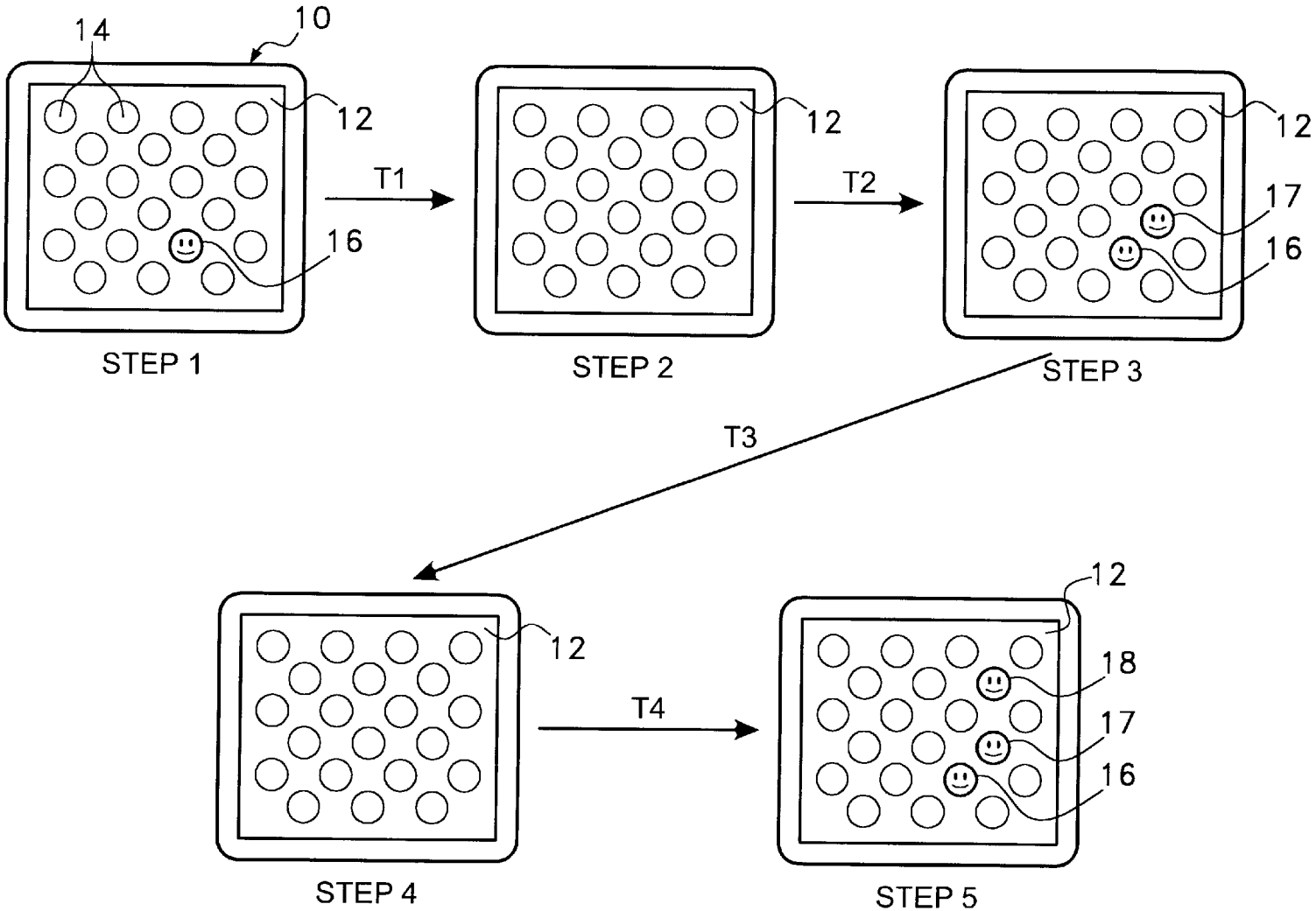
FIG. 1 is a schematic illustrating a game field and showing how the appearance of the game field changes during the course of play.

Referring to FIG. 1, a display monitor 10 is shown. The display monitor 10 can either be a computer monitor or a television monitor. The game field 12 is shown on the display monitor 10, wherein the game field 12 is used in the play of the game. If the display monitor 10 is a computer monitor, the game field 12 can be generated by a computer using dedicated game software. Alternatively, the game field 12 can be downloaded to a computer using an Internet connection to a website that contains the game software. If the display monitor 10 is a television monitor, the game field 12 can be provided by a game interface, such as the Nintendo game system or the PlayStation game system.

The game field 12 contains a plurality of object areas 14. The object areas 14 are presented in a pattern throughout the game field 12. In the shown embodiment, the object areas 14 are circles that are arranged in a plurality of rows and staggered columns. Such an arrangement is merely exemplary and is must be understood that the object areas 14 can have any shape or can have different shapes. It should also be understood that the object areas 14 can be arranged in any pattern, including random patterns throughout the game field 12 or any part of the game field 12.

Referring to Step 1 in FIG. 1 it will be understood that to play the game, an object 16 is first presented in one of the object areas 14. In the shown example, the object 16 presented is a smile face. The first object 16 is shown in one object area 14 for a time period T1 that can be indefinite. After a player decides to proceed, Step 2 occurs. In Step 2, the game field 12 is either cleared of all objects or completely filled with objects, in order to present a neutral game field. In the shown illustration, a neutral game field devoid of any objects is shown. The neutral game field is displayed for a second period of time T2. The second period of time T2 can be a fraction of a second or a period as long as ten seconds. After a second time period T2, Step 3 occurs.

In Step 3, the first object 16 again appears in the same object area position in the game field. However, the first object 16 is now joined by a second identical object 17 in one of the other object areas 14. At this point, a player must now identify which of the two shown objects 16, 17 is the new object 17 that did not appear in Step 1. The player can be provided with a limited time period T3 in which to identify the new object 17 or an unlimited period of time can be provided.

A player can identify the new object 17 in many ways. If the game field is on a computer monitor, a player can point and click on the new object 17 using a mouse curser. If a game field is present on a television monitor using a game system, the control pads of the game system can be utilized to select the object believed to be new. If a player successfully selects the new object 17, the game progresses to Step 4. In Step 4, the game field 12 is again shown to be neutral for the same predetermined period of time T4 as was provided in Step 2. After that period of time T4 has passed, Step 5 occurs. In Step 5, the previously displayed two objects 16, 17 are now joined with a third object 18 in a third randomly selected object area 14. The player must now identify which of the shown objects 16, 17, 18 is the newly displayed third object 18. If the player is successful, the game continues by adding a subsequent object to the game field 12. In between each addition of a new object, the game field 12 is shown as a neutral field. This process continues until there are no longer any unused object areas 14 in the game field 12. If a player completes the pattern and enables the whole game field to be filled, that player wins. However, if a player identifies an old object as the newly added object, the player loses and the game ends.

It will be understood that the level of difficultly associated with the game depends upon the number of object areas 14 presented on the game field 12, the pattern in which the game field 12 is filled and the visual confusion created by the game field 12. In the illustrated example, simple circular object fields are used that are filled with smile faces. However, much more confusing game fields can be used. For example, the game field can be designed as a wall of crowded bookshelves. The objects added can be books of different colors, heights and widths randomly added to the bookshelves. In such a scenario, the clutter of books already on the bookshelves create a good deal of visual confusion, thereby making the game harder to play.

Another example can use a theme landscape, such as a farm, firehouse, kitchen or the like, as the game field. If a theme landscape is used for the game field, the objects that are added or removed would have the same theme, as does the game field. For example, if the game field is a barnyard, the objects added or removed can be farm animals, farm equipment, crops and other objects a person would expect to see in a barnyard.

It should also be understood that the method of play described in relation to FIG. 1 can be reversed. In the method embodied by FIG. 1, an object was added to the game field after each successful turn. It will be understood, that the method of play can also be played in reverse, wherein a game field full of objects is provided and an object is removed at each turn. The player must then identify what object was removed rather than what object was added. Accordingly, the present invention can be played either by adding or removing objects from the game field.

Figure 2:
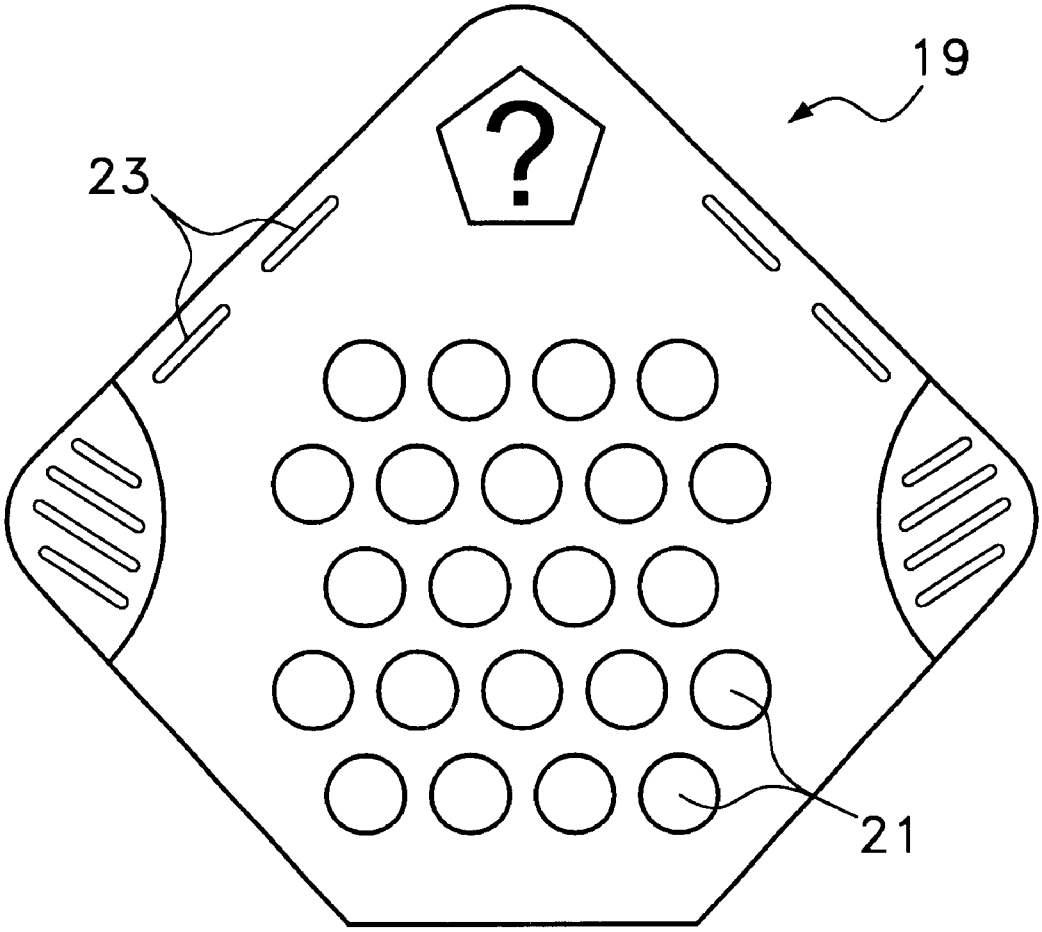
FIG. 2 is a top view of an electronic game that can be used to play the present invention.

Referring top FIG. 2, a dedicated electronic game 19 is shown. On the game are a plurality of buttons 21. The buttons 21 can be selectively illuminated by internal circuitry. To play the game, one of the buttons 19 is illuminated for a period of time. Either the one illuminated button is turned off or all of the buttons 19 are then illuminated to provide a neutral field. The first illuminated button is then again illuminated with a second illuminated button. A player must press the newly illuminated button to play the game. The board game 19 can thereby be played in the same manner as was described with reference to FIG. 1.

Control buttons 23, such as on/off buttons, volume controls, difficulty level controls and the like can be provided on the game 19.

Figure 3:
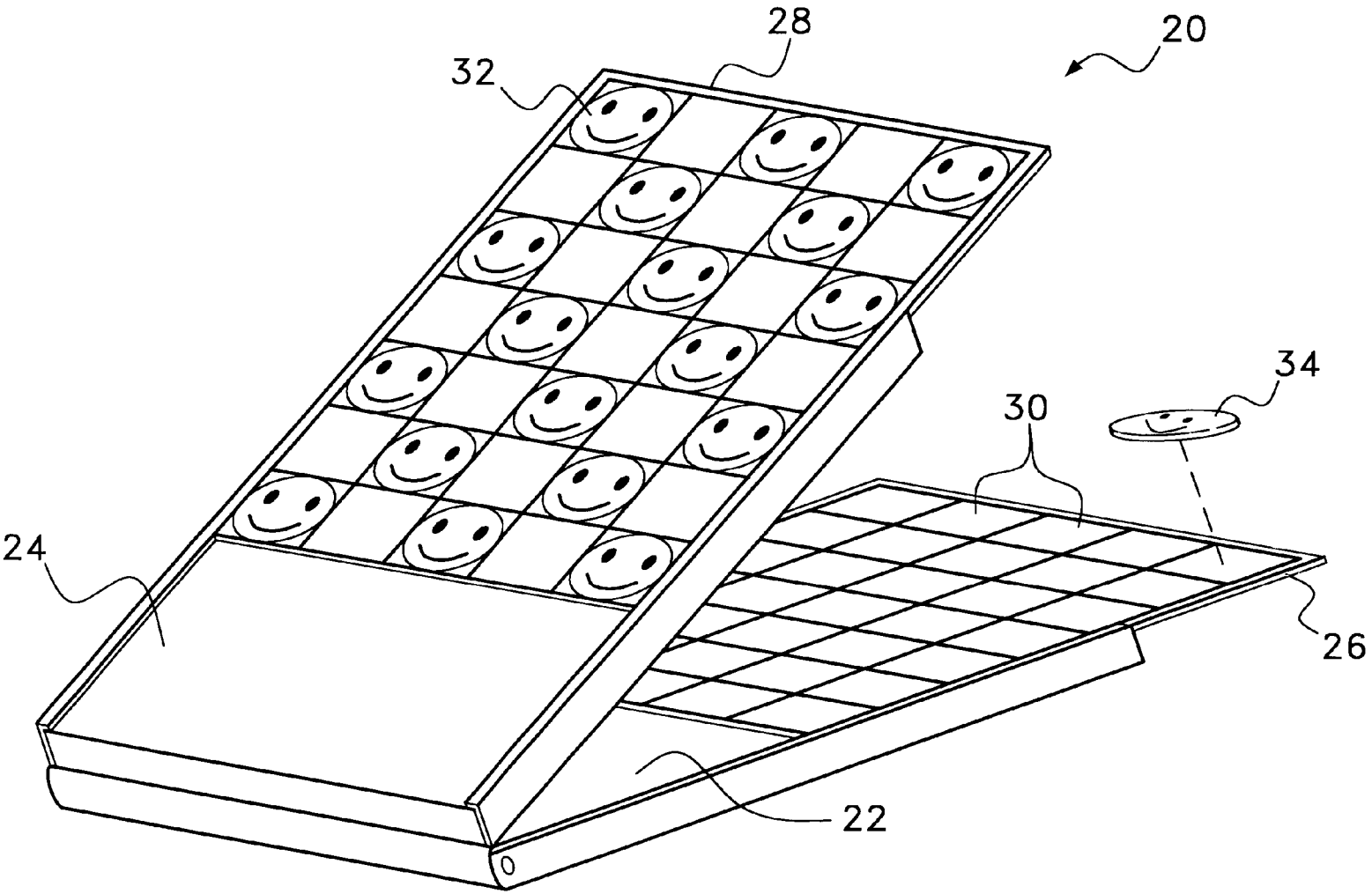
FIG. 3 is a perspective view of a board game that can be used to play the present invention game.

Referring to FIG. 3, a board game version of the present invention is disclosed. In this embodiment of the invention, a board game 20 is provided having a playing surface 22. The playing surface 22 is covered by a lid 24 that can be selectively used to cover the playing surface 22. A plurality of pattern cards 26 and cover cards 28 are provided with the game. On the surface of each pattern card 26 is a printed pattern of a plurality of object areas 30. The printed pattern of object areas 30 can be any design. However, the row and column pattern used in the embodiment of FIG. 1 is again used to help provide continuity between the embodiments. The cover cards 28 show the same pattern as is on the pattern cards 26, except the object areas are shown covered by the images of playing pieces 32. As such, the pattern cards 26 show patterns and the cover cards 28 show those same patterns covered with images of playing pieces 32.

Physical playing pieces 34 are provided. The playing pieces 34 are objects that can be placed on the pattern cards 26. When all the object areas 30 of the pattern card 26 are covered with playing pieces 34, the pattern card 26 has the same appearance as does the cover card 28.

To play the game, a pattern card 26 is placed over the playing surface 22 and a cover card 28 is placed over the lid 24. One player places a playing piece 34 onto the pattern card 26. The placement of the initial piece is shown to a second player. The lid 24 is then used to block the view of the pattern card 26 and a second playing piece 34 is placed on the pattern card 26. The lid 24 is then rotated out of the way and the second player must identify which of the playing pieces 34 has just been added. This cycle continues until the pattern card 26 is filled with playing pieces 34 and the pattern card 26 has the same appearances as does the cover card 28.

It will therefore be understood that the method of play associated with the game board of FIG. 3 is the same as the electronic version of the game described in association with FIG. 1. Except, in FIG. 3, instead of the game board electronically changing at set intervals, the lid 24 of the game board is used to momentarily obstruct the pattern card 26 as a new game piece is manually added.

Figure 4:
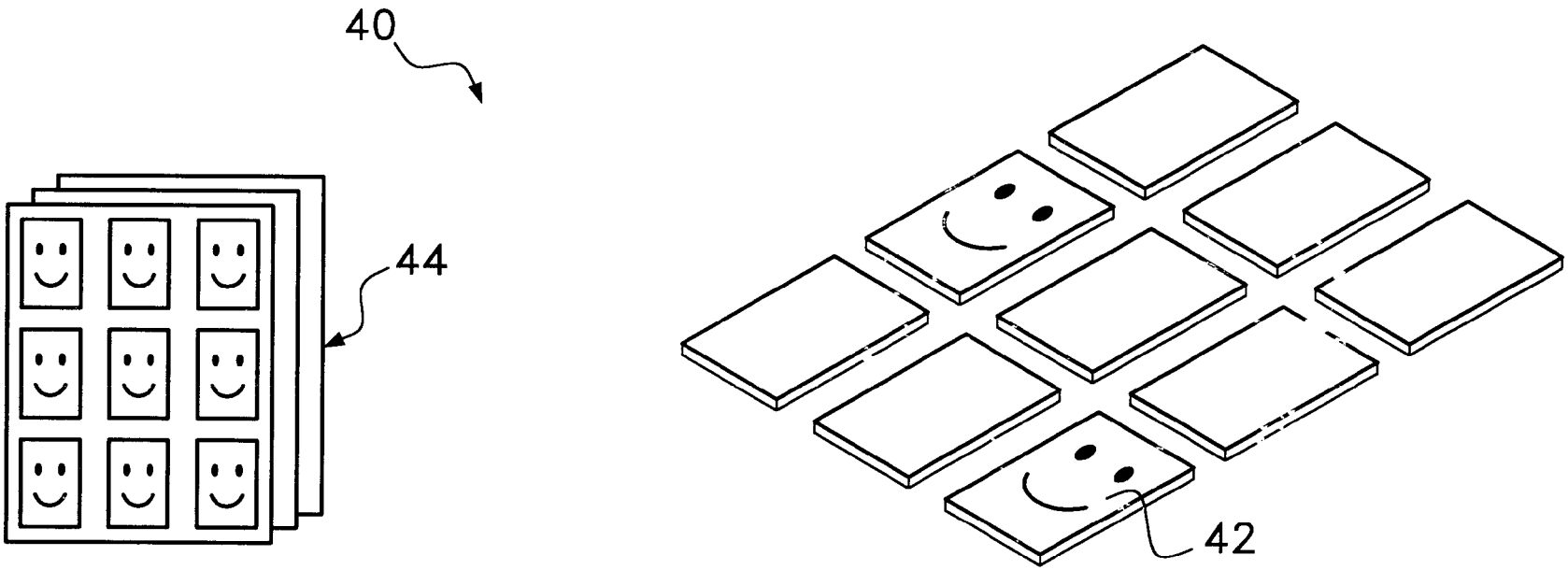
FIG. 4 is perspective view of card sets that can be used to play the present invention game.

Referring to FIG. 4, one of the simplest versions of the present invention game is illustrated. In this version the game is a card game 40. To play the game, two sets of cards are provided. The two sets of cards include object cards 42 and pattern cards 44. The object cards 42 contain cards with an object image on its face side and a generic image on its back side. All the object cards 42 in a set are identical. The pattern cards 44 illustrate the object cards 42 arranged in some pattern, wherein all of the cards are illustrated either face up or face down.

To play the game, a first player arranges the object cards 42 face down in a pattern that matches one of the patterns on one of the pattern cards 44. One object card is then turned over and a second player looks at the object cards 42. The second player is then told to turn around and look at the pattern card 44 that matches the pattern used in laying out the object cards 42. While the second player is looking at the pattern card 44, the first player turns over a second object card 42 and the second player is asked to again look at the object cards 42. The second player must then identify the newly turned object card 42. If successful, the cycle is repeated until all of the object cards 42 are turned.

Figure 5:
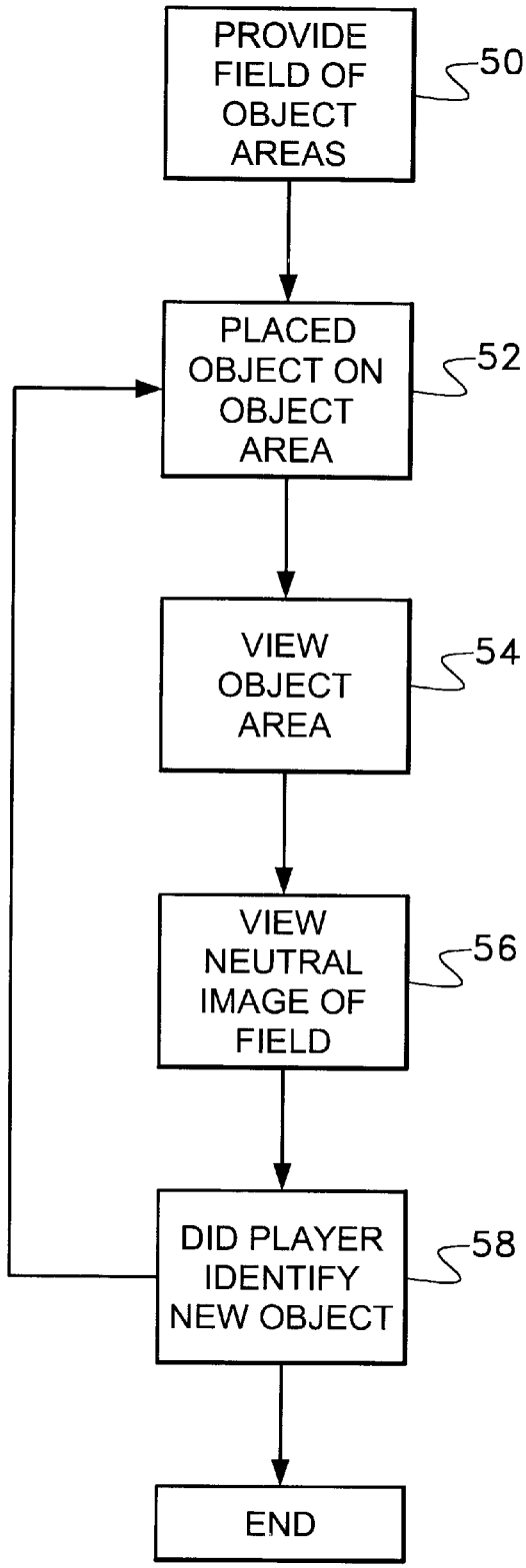
FIG. 5 is a block diagram logic flow illustrating the method of play for the present invention game.

In the embodiments of FIG. 1, FIG. 2, FIG. 3 and FIG. 4, the method of play remains the same eventhough the medium through which the game is presented varies. Referring to FIG. 5, it will be seen that the method of play that remains constant has the following steps. As is indicated by Block 50, a pattern field of object areas is provided, wherein each of the object areas has the same appearance. To start the game, one object is displayed in one of the object areas. See Block 52. The player is allowed to see the object areas and observe the object placement on the object areas. See Block 54. The player then momentarily views an image of a neutral pattern field, wherein all of the object areas have the same appearance. See Block 56. During this period, another object is added to the pattern field and the pattern field is then shown to the player. The player must then identify which of the objects displayed on the pattern field is the newly added object. See Block 58. If the player does not successfully identify the new object, the game is over. However, if the player does successfully identify the newly added object, the cycle is repeated until the player fails to recognize the new object or until all the object areas in the pattern field are filled.

It will be understood that the game and method of play for the present invention that are described and illustrated are merely exemplary and a person skilled in the art can make many variations to the shown embodiment. All such alternate embodiments and modifications are intended to be included within the scope of the present invention as defined below in the claims.

What is claimed is:

1. A method of playing a game, comprising the steps of:

a) providing a pattern field that contains a pattern of object areas thereon;

b) altering a first of said object areas on said pattern field, to create a first altered object area;

c) displaying the pattern field with said altered object area to a player;

d) altering a subsequent one of said object areas to create a subsequent altered object area;

e) displaying the pattern field with said first altered object area and said subsequent altered object area to the player;

f) having the player identify which subsequent altered object area was last added to said pattern field.

2. The method according to claim 1, further including the step of repeating steps (d), (e) and (f) until the player fails to identify which subsequent altered object area was added to the pattern field.

3. The method according to claim 2, further including the step of repeating steps (d), (e) and (f) until all of said object areas on said pattern field have been changes to subsequent altered object areas.

4. The method according to claim 1, further including the step of displaying a neutral pattern field to the player while a subsequent altered object area is added to the pattern field.

5. The method according to claim 1, wherein said step of providing a pattern field includes providing a pattern field on a display monitor.

6. The method according to claim 5, wherein said step of altering a first object includes area electronically displaying an object in one of said object areas on said pattern field.

7. The method according to claim 6, wherein said step of placing a subsequent object includes electronically displaying an object in one of said object areas randomly selected from said pattern field.

8. A method of playing a game, comprising the steps of:

a) providing a plurality of objects arranged in an original pattern;

b) altering one of said objects in said original pattern to create a first altered pattern;

c) enabling a player to view said first altered pattern;

d) showing said original pattern to the player for a predetermined period of time;

e) altering a subsequent one of said objects during said predetermined period of time to create a subsequent altered pattern; and f) enabling a player to view said subsequent altered pattern and attempt to identify which of said objects was last altered.

9. The method according to claim 8, further including the step of repeating steps (d), (e) and (f) until the player fails to identify which subsequent object was last altered.

10. The method according to claim 8, further including the step of repeating steps (d), (e) and (f) until all of said plurality of objects are altered.

11. The method according to claim 8, wherein said step of providing a plurality of objects includes electronically displaying a plurality of objects on a display monitor.

12. The method according to claim 8, wherein said step of providing a plurality of objects includes providing cards and arranging said cards in said original pattern.

13. The method according to claim 12, wherein said step of altering a subsequent one of said objects includes turning over one of said cards.

14. The method according to claim 8, further including the step of providing a game board upon which said plurality of objects are placed.

15. A method of playing a game, comprising the steps of:

a) providing a plurality of objects;

b) placing a first of said objects in a field of play;

c) having a player view the field of play for a predetermined period of time;

d) placing a subsequent one of said objects in said field of play, while the player is not looking at said field of play;

e) having the player again look at the field of play and identify which of said objects was newly added to said field of play; and f) repeating steps (d) and (e) until all of said plurality of objects are added to said field of play.

16. The method according to claim 15, wherein said field of play is an image on an electronic display and said plurality of objects are electronically generated images.

17. The method according to claim 15 further including the step of having the player view an unchanging image of said field of play during step (d).

* * * * *